US005134932A

United States Patent [19]

Fujino

[11] Patent Number: 5,134,932

[45] Date of Patent: Aug. 4, 1992

[54] SELF ADJUSTING PRINTING DEVICE AND METHOD

[75] Inventor: Noboru Fujino, Musashimurayama, Japan

[73] Assignee: Kabushiki Kaisha Shinkawa, Tokyo, Japan

[21] Appl. No.: 561,054

[22] Filed: Aug. 1, 1990

[30] Foreign Application Priority Data

Aug. 1, 1989 [JP] Japan ..... 1-200061

[51] Int. Cl.[5] ..... B41F 17/00

[52] U.S. Cl. ..... 101/44; 101/318; 101/484

[58] Field of Search ..... 101/DIG. 36, 318, 163, 101/41, 44, 483, 484

[56] References Cited

U.S. PATENT DOCUMENTS 4,516,495 5/1985 Ericsson ..... 101/127.1 X 4,745,857 5/1988 Putnam et al. ..... 101/163 X

FOREIGN PATENT DOCUMENTS 3535863 4/1987 Fed. Rep. of Germany ..... 101/163

*Primary Examiner*—Clifford D. Crowder

*Attorney, Agent, or Firm*—Koda and Androlia

[57] ABSTRACT

A marking device and method using a plate holder with a printing plate attached, an X-Y-Z driver which moves the plate holder in the X, Y and Z directions, a camera installed downstream of the printing position on a work piece feeding line so that the camera photographs the character width and position of the character printed on the work piece, and a computer which calculates the difference between the width of the printed character and predetermined standard character width and/or the discrepancy in the printed character position. The computer further alters, for the next work piece, the amount of imprinting movement of the printing plate into the work piece and/or the printed character position by controlling the X-Y-Z driver based upon the data representing the difference in the printed character width and/or the data representing the discrepancy in the printed character position.

4 Claims, 3 Drawing Sheets

SELF ADJUSTING PRINTING DEVICE AND METHOD

BACKGROUND OF THE INVENTION

1. Field of the Invention

The present invention relates to a marking method and device which uses letterpress printing.

2. Prior Art

FIG. 4 shows one of the conventional marking devices.

In this device, a plate holder 51 to which a printing plate (rubber stamp) 50 is attached is installed on a plate holder attachment 52 so that the plate holder 51 can slide in the Y direction which is a direction perpendicular to a lever 54. The plate holder 51 is mounted on the plate holder attachment 52 via a screw 53.

The plate holder attachment 52 is inserted into the lever 54 which extends in the X direction. The attachment 52 is fastened via a screw 55.

The lever 54 is inserted into a moving block 56 which is driven by a predetermined amount in the vertical direction and in the X and Y directions via a driving means (not shown). The lever 54 is fastened in place by a screw 57.

In this device, the position of the printing plate with respect to the Y direction is adjusted by loosening the screw 53 and moving the plate holder 51 in the Y direction. The position of the printing plate 50 in the Z direction is adjusted by loosening the screw 55 and raising or lowering the plate holder attachment 52, and the position of the plate 50 in the "$\theta$" direction can be adjusted by loosening the screw 55, and moving the lever 54 in the horizontal direction.

Since the printing plate 50 is used in the prior art device, characters formed on the plate 50 become worn. As a result, the width of the printed characters changes and/or a discrepancy is generated in the printed character position.

In this case, according to conventional method, a sample of a printed character is picked up, and the printed character's width and any discrepancy in the printed character position are measured visually or by using a measuring instrument.

If any change in the width of the printed character is found, the screw 55 is loosened, the plate holder attachment 52 is raised or lowered for proper adjustments, then the screw 55 is tightened back. After this, printing is performed, and the printed character position is reexamined so that the printed character position is adjusted by repeating the above steps until the correct position is obtained.

If a discrepancy in the printed character position is found, the screws 53 and 57 are loosened, and the plate holder 51 and the lever 54 are moved in the Y and X directions, respectively. After this, the screws 53 and 57 are tightened back, printing is performed and then the printed character position is examined. Based upon the result of the examination, the printed character position is adjusted to the correct position by repeating the steps described above.

In the conventional method, however, a good quality printing can only be achieved by repeating the operations of (a) stopping the device, (b) measuring the printing condition, (c) mechanically adjusting the amount of lowering of the plate holder 51 and the Y direction of the holder 51 and (d) then performing the printing.

Thus, the measurement and adjustment cannot be performed unless the device is stopped. The correct values cannot be ascertained without performing a test printing after such an adjustment, and considerable time and skill are required to make such an adjustment.

SUMMARY OF THE INVENTION

Accordingly, one object of the present invention is to provide a marking method and device which performs a uniform character width printing without stopping the operation of the device.

Another object of the present invention is to provide a marking method and device which allows a printing at a fixed position to be achieved without stopping the operation of the device.

In order to accomplish the object, the marking method of the present invention utilizes the steps of:

recording or photographing a printed character width and/or a printed character position on a work piece, on which a printing of a character has been performed, by a camera which is installed downstream of the printing position on a feeding line of the work piece, calculating via a computer the data representing the difference between the printed character width and a standard character width and/or the data representing the discrepancy in the printing position, and based upon such a calculation result, an adjustment in the amount of vertical or downward motion which the plate holder (on which the printing plate is attached) makes and/or the position of the plate holder in the X and Y directions is performed so that the amount of imprinting of the printing plate onto the work piece and/or the character printing position are changed to a proper amount and/or a proper position for the next work piece onto which the printing is performed.

The marking device that uses the method described above includes:

a plate holder to which a printing plate is attached, an X-Y-Z driving means which moves the plate holder in the X, Y and Z directions, a camera installed at a point that is located farther down in the direction of feeding of the work piece than the printing position so as to record the printed characters, in other words, a camera is installed downstream of the printing position on a work piece feeding line so that the camera records or photographs the (width and position of the) character printed on the work piece, and a computer which calculates the difference between the printed character width (which is recorded via the camera) and a preset standard width for a character to be printed and/or the discrepancy in the printed character position, and then alters the amount of indentation of the printing plate onto the work piece and/or the printed character position by controlling the X-Y-Z driving means in accordance with the data representing the difference in the printed character width and/or data representing the discrepancy in the printed character position.

In the method and device as described above, an image of the printed work is obtained via the camera, and the computer controls the amount of vertical motion of the plate holder in accordance with the data representing the difference between the standard character width and the actually printed character width, so that the amount of imprinting of the printing plate is properly adjusted. Accordingly in this manner, printing of uniform character width can be achieved.

Furthermore, the computer controls the position of the plate holder in the X and Y directions in accordance with data representing the discrepancy in the printed character position recorded by the camera, and the printed character position is corrected accordingly. Accordingly, printing is performed at a correct fixed position.

The actions described above can be performed without stopping the device; therefore, there is no drop in productivity.

DETAILED DESCRIPTION OF THE INVENTION

Figure 3:
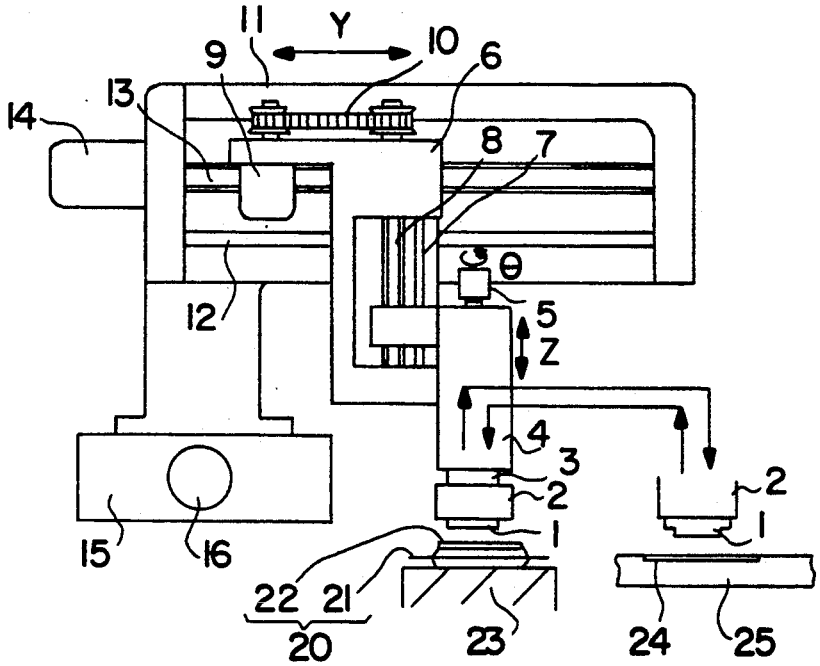
FIG. 3 is a left side view thereof.
Figure 4:
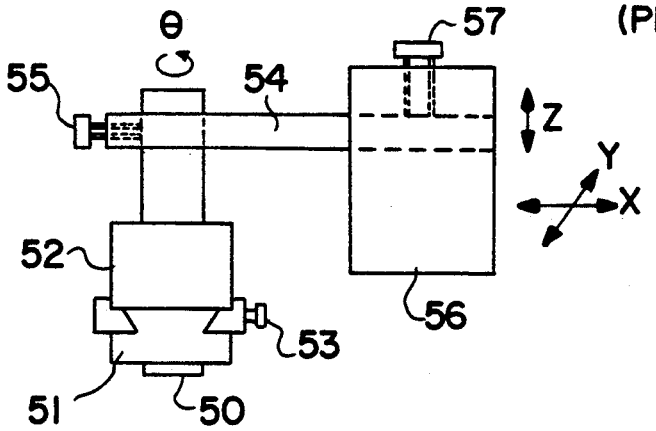
FIG. 4 (PRIOR ART)
FIG. 4 is a front view of conventional marking device.

As shown in FIG. 3, a plate holder 2 to which a printing plate (rubber stamp) 1 is attached is detachably mounted to a rotary shaft 3. The rotary shaft 3 is supported on a vertically moving table 4 so that the shaft 3 is rotatable.

The rotary shaft 3 is rotated by a $\theta$-direction driving motor 5 which is mounted to the top of the vertically moving table 4.

The vertically moving table 4 slides on a guide rod 7 which is perpendicularly installed on a first horizontally moving table 6.

The vertically moving table 4 is screwed to a Z-direction feed screw 8 which is supported on the first horizontally moving table 6 and parallel to the guide rod 7.

The Z-direction feed screw 8 is driven, via a belt 10, by a Z-direction driving motor 9 which is mounted on the first horizontally moving table 6.

The first horizontally moving table 6 is slidable on a guide rod 12 which is installed, in the horizontal Y direction, on a second horizontally moving table 11.

The first horizontally moving table 6 is also screwengaged with a Y direction feed screw 13 which is supported on the second horizontally moving table 11 and parallel to the guide rod 12. The Y direction feed screw 13 is driven by a Y direction driving motor 14 which is mounted on the second horizontally moving table 11.

The second horizontally moving table 11 is installed on a base 15 so that the table 15 slides in the X direction which is horizontal with reference to the base 15 and is driven via an X-direction feed screw (not shown) by an X-direction driving motor 16 which is provided on the base 15.

With the structure above, when the $\theta$-direction driving motor 5 is driven, the plate holder 2 is rotated in the $\theta$ direction.

When the Z-direction driving motor 9 is driven, the Z-direction feed screw 8 is rotated through the belt 10, so that the plate holder 2 is caused to move in Z direction along with the vertically moving table 4.

When the Y-direction driving motor 14 is driven, the first horizontally moving table 6 is caused to move in the Y direction by the Y-direction feed screw 13, and the plate holder 2 is thus also caused to move in the Y direction.

Similarly, when the X-direction driving motor 16 is driven, the second horizontally moving table 11 is caused to move in the X direction, and the plate holder 2 is also caused to move in the X direction.

The work piece 20 on which a printing is performed consists of a frame 21 and a printing section 22 which is made of a resin. Printing sections 22 in plural number are provided at equal intervals on the frame 21. An ink holder 25 containing ink 24 is installed away from, in the Y direction, a work-carrying table 23 on which the work piece 20 is set.

Figure 1:
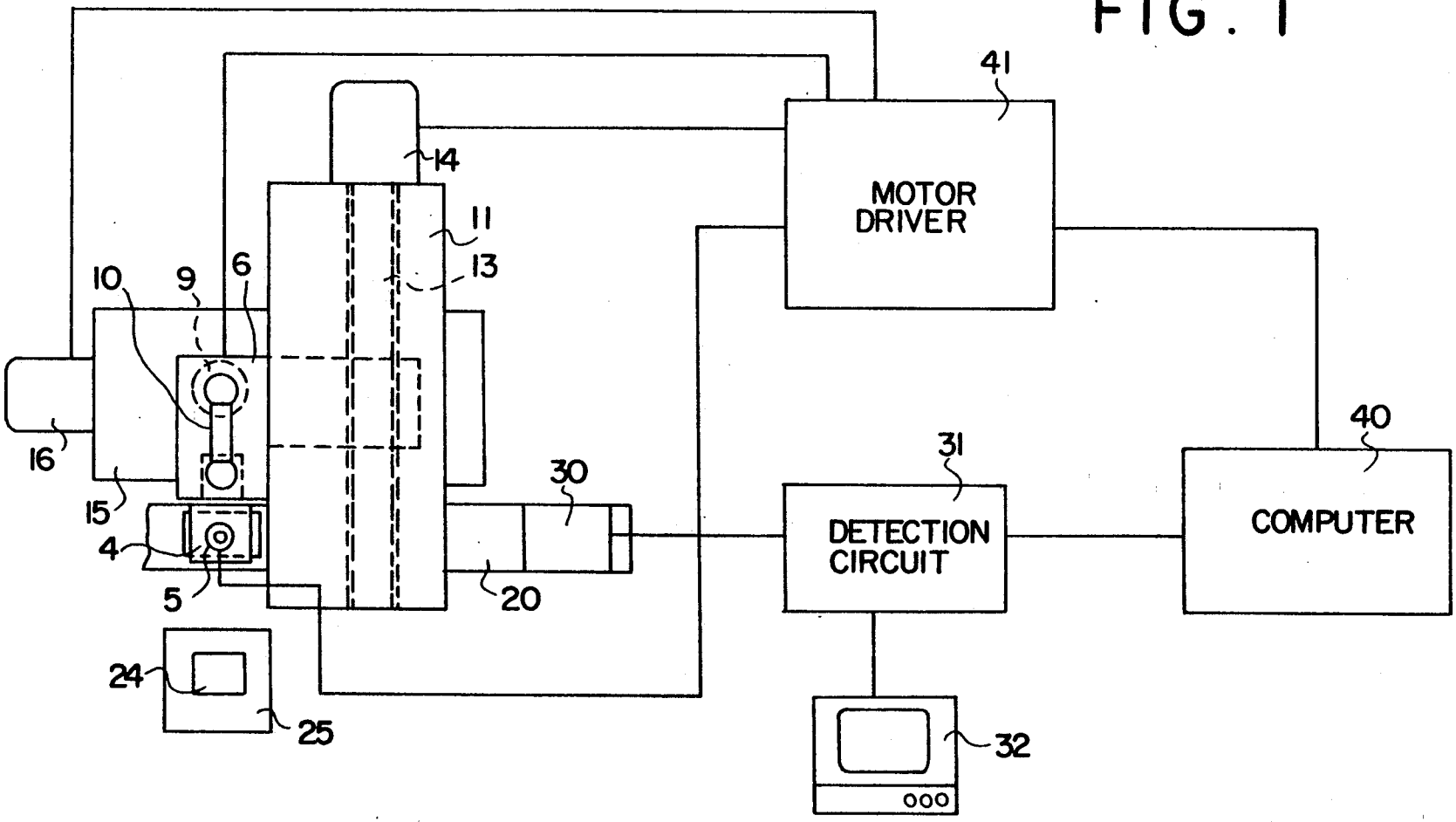
FIG. 1 is an illustration of a plan view of a marking device in accordance with the present invention.
Figure 2:
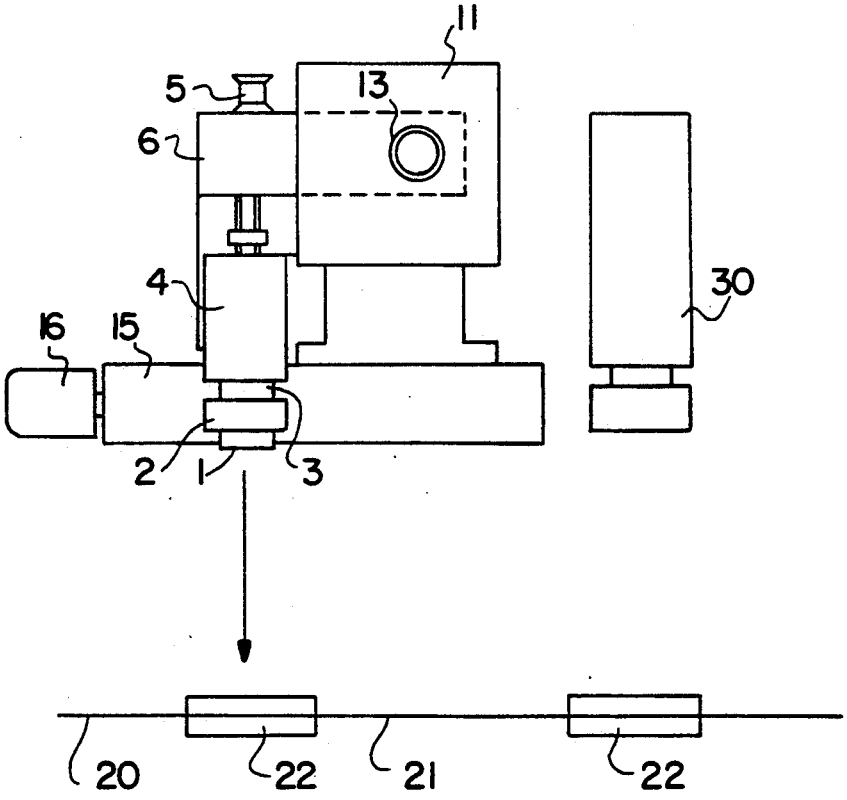
FIG. 2 is a front view thereof.

As shown in FIGS. 1 and 2, a camera 30 which takes pictures of the printed work 20 is installed in a position which is away from the printing position in the direction of feeding of the work piece 20 (i.e., in the X direction) by an amount corresponding to the feed pitch of the work piece 20 (which is an integral multiple of the pitch of the printing sections 22). Image signals from this camera 30 are processed by a detection circuit 31 and displayed on a monitor 32.

The $\theta$-direction driving motor 5, Z-direction driving motor 9, Y-direction driving motor 14 and X-direction driving motor 16 are driven by a motor driver 41 upon command signals from a computer 40.

In the computer 40 are stored two types of programs. One is for controlling the printing operation which is indicated by the solid line arrows in FIG. 3. The other is for (1) first calculating the difference and/or discrepancy between (a) the standard printing character width and the printing position and (b) the actually printed character width and character printed position which are photographed by the camera 30 and then processed by the detection circuit 31, and then (2) correcting the amount of imprinting movement (amount of vertical motion) and horizontal position of the printing plate 1.

The amount of imprinting movement which the printing plate 1 would make, which is set based upon various differences in the actual printed character width relative to the standard printing character width, is determined beforehand based upon tests.

In operation, printing is performed via the motor driver 41 with the use of printing operation program stored in the computer 40 which is shown by the solid line arrows in FIG. 3.

More specifically, ink 24 is applied to the printing plate 1 by a combination of (a) the movement of the plate holder 2 in the Z direction (effected by the Z direction driving motor 9) and (b) the movement of the plate holder 2 in the horizontal plane (effected by the Y-direction driving motor 14 and X-direction driving motor 16). Afterward, printing is successively performed on each printing section 22 of the work piece 20, and after each printing, the work piece 20 is fed by a predetermined pitch.

When the printing section 22, on which the printing has been performed, is positioned beneath the camera 30, the printed character(s) is recorded or photographed by the camera 30. The printed character(s) is then processed by the detection circuit 31 and displayed on the monitor 32. The processed data of the printed character(s) is also sent to the computer 40.

The computer 40 compares the data representing the standard printing character width and printing position with the data representing the actually printed character width and the position of the printed character.

If the difference is out of a predetermined range, the amount of imprinting movement (amount of downward movement) and printing position (horizontal inclination) of the printing plate are calculated on the basis of such difference (including the resolution power of the motors 9, 14 and 16). Then, beginning with the next work piece to which the printing is performed, the printing operation program is adjusted on the basis of the resultant of such a calculation, and the Z-direction driving motor 9, Y-direction driving motor 14, X-direction driving motor 16 and $\theta$-direction driving motor 5 are driven accordingly.

In the embodiment described above, both the printed character width and the printed character position are corrected; however, it would be possible to correct only one of the two values (either the character width or the printing position).

As is clear from the above description, according to the present invention, the printed character width is detected, and the amount of imprinting movement of the printing plate is properly adjusted automatically. As a result, printed characters with uniform width are obtained without stopping the operation of the device. In addition, since the printing position can also be detected and corrected automatically, printing at a fixed position can also be achieved without stopping the device.

I claim:

1. A marking device comprising:

a plate holder to which a printing plate is attached;

an X and Y driving means which moves said plate holder in the X and Y directions;

a Z driving means which moves said plate holder in the Z direction;

a camera installed downstream of a printing position on a work piece feeding line, said camera recording the characters printed on said work piece; and a computer which (i) calculates the difference between a printed character width and a character printing width which has been set beforehand, and (ii) alters the amount of movement of said printing plate in said Z direction onto said wok piece by controlling said Z driving means based upon data representing said difference in printed character width.

2. A marking method comprising the steps of:

printing characters on a work piece by vertically moving a printing plate mounted on a plate holder;

photographing character widths of said characters printed on said work piece by a camera which is installed downstream of a printing position on a work piece feeding line;

calculating data representing the difference between the character widths of said photographed characters and predetermined standard printing character widths of said photographed characters by a computer;

adjusting the amount of vertical movement of said plate holder based on the results of said calculation; and printing the next work piece after adjusting an amount of vertical movement of said plate holder.

3. A marking device comprising:

a plate holder to which a printing plate is attached;

X-Y-Z driving means which move said plate holder in the X,Y and Z directions;

a camera installed downstream of a printing position on a work piece feeding line, said camera recording the characters printed on said work piece; and a computer which calculates the difference between a printed character width and a character printing width which has been set beforehand and a discrepancy in the printed character poisition and alters the amount of movement of said printing plate in said Z direction onto said work piece and the character printing position by controlling said X-Y-Z drinving means based upon data representing said difference in printed character width and data representing said discrepancy in the printed character position.

4. A marking method comprising the steps of:

printing characters on a work piece by vertically moving a printing plate mounted on a plate holder;

photographing character widths and character positions of said chartacters printed on said work piece by a camera which is installed downstream of a printing position on a work piece feeding line;

calculating data representing the difference between the character width of said photographed characters and predetermined standard printing character widths and data representing the discrepancy in printing positions of said photographed characters by a computer;

adjusting the amount of vertical movement of said plate holder based upon the results of said calculatins; and printing the next work piece after adjusting an amount of vertical movement of said plate holder based upon said adjustment.

* * * * *